United States Patent [19]

Leary

[11] Patent Number: 4,922,735

[45] Date of Patent: May 8, 1990

[54] BOAT ACCESSORY LOCKING DEVICES

[76] Inventor: Michael J. Leary, 25 Smith La., Kingston, Mass. 02364

[21] Appl. No.: 354,791

[22] Filed: May 22, 1989

[51] Int. Cl.[5] ..... E05B 73/00

[52] U.S. Cl. ..... 70/58

[58] Field of Search ..... 70/57, 58, 63, 19, 61, 70/14; 114/343; 211/4, 8, 9

[56] References Cited

U.S. PATENT DOCUMENTS 1,816,334 7/1931 Matthews ..... 211/8

2,497,797 2/1950 Rogers ..... 70/58

3,125,873 3/1964 Robinson ..... 70/63

*Primary Examiner*—Robert L. Wolfe

*Attorney, Agent, or Firm*—H. Jay Spiegel

[57] ABSTRACT

The present invention relates to boat accessory locking devices. A first such locking device consists of a locking mechanism designed to be affixed between structure on a boat and structure on a pair of oars to lock the oars to the boat in a manner preventing theft. The second locking device consists of a lock for the oar locks of a boat which includes a compartment designed to receive the oar locks, a cover and a lock.

5 Claims, 3 Drawing Sheets

BOAT ACCESSORY LOCKING DEVICES

BACKGROUND OF THE INVENTION

The present invention relates to boat accessory locking devices. In the prior art, locking devices are known, per se; however, no such device is known which includes all of the structure and function of the embodiments of the present invention.

The following prior art is known to applicant:

U.S. Pat. No. 2,785,563 to Strollis discloses a safety device for outboard motors which includes a locking mechanism preventing an outboard motor from being removed from the transom of an associated boat.

U.S. Pat. No. 2,930,218 to Ashmore discloses an outboard motor lock designed, again, to prevent unauthorized removal of an outboard motor from the transom of an associated boat.

U.S. Pat. No. 4,296,615 to Zoor discloses an anti-theft arrangement, particularly for a mast of a sailing craft. The inventive locking mechanism is designed to be used to lock a rod-shaped object in a position preventing unauthorized removal.

Finally, U.S. Pat. No. 4,328,687 to Ritchie discloses a locking device designed to be used to lock a firearm to a wall and including an elongated rod which may be extended through structure on a firearm and thence through a lock portion. The device is only releasable through the use of a key.

The teachings of these patents differ from the teachings of the present invention as failing to contemplate the particular environments of use contemplated by the devices disclosed herein and as failing to contemplate the specific structure thereof.

SUMMARY OF THE INVENTION

The present invention relates to boat accessory locking devices. The present invention includes the following interrelated aspects and features:

(a) In each of the devices forming a part of the present invention, the locking device includes structure attachable to a portion of a vessel such as a boat, other structure in which a boat accessory which is to be locked thereto may be inserted, and some latching mechanism to lock the boat accessory in a locked position.

(b) A first such locking device in accordance with the teachings of the present invention consists of a device designed to be used to lock a pair of oars on a boat to prevent theft. The device includes a receptacle bolted to the boat at the bow or transom, as desired, with the receptacle including a vertically extending recess therein. A small hole is formed at the end of each oar which does not significantly affect the efficiency of the oar in use. When it is desired to lock the oars to the inventive locking device, the tips of the oars are inserted into the above-described receptacle with the holes therethrough aligned with one another and with vertically spaced holes in the receptacle. Thereafter, a pin is inserted through the holes in the receptacle, as well as through the holes in the oars, and a padlock or other locking means is attached to the pin to prevent the removal of the pin from the receptacle.

(c) A further locking device forming a part of the present invention is provided to prevent theft of oar locks. This second locking device includes a receptacle sized and configured to receive therein a pair of oar locks and having sufficient depth to contain the oar locks therein. An upstanding post extends upwardly in the receptacle and a cover may be placed over the receptacle with the cover having a slot fitting over the post. The post includes an opening therethrough which remains exposed even when the cover is placed over the post with two oar locks contained in the receptacle. A padlock or other locking means may be inserted through the opening in the post to lock the cover over the receptacle, thus removably retaining the oar locks therein.

As such, it is a first object of the present invention to provide boat accessory locking devices.

It is a further object of the present invention to provide such devices including one such device for locking oars to a vessel and another such device for locking oar locks to the vessel.

It is a yet further object of the present invention to provide such devices which are easy to use and effective in preventing theft of boat accessories.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
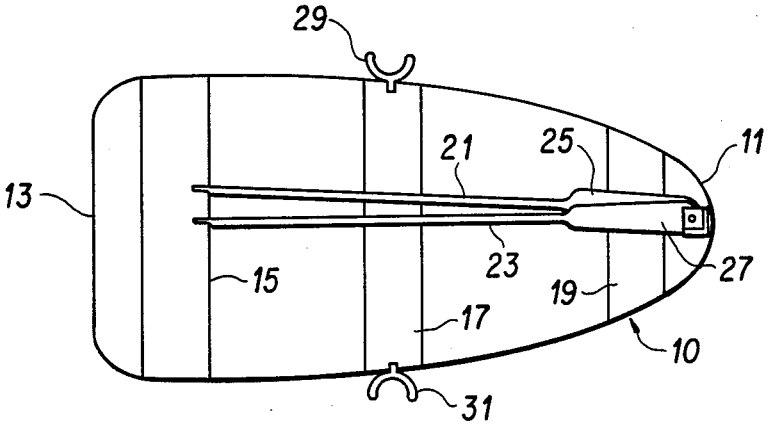
FIG. 1 shows a top view of a boat with the oars locked with the oar locking device forming a part of the present invention.

With reference, first, to FIG. 1, a boat 10 is seen to include a bow 11, a transom 13, seats 15, 17 and 19, oars 21, 23 having respective paddles 25, 27 and oar locks 29, 31. As is known, the oars 21, 23 and oar locks 29 and 31 may easily be stolen from such a boat.

Figure 2:
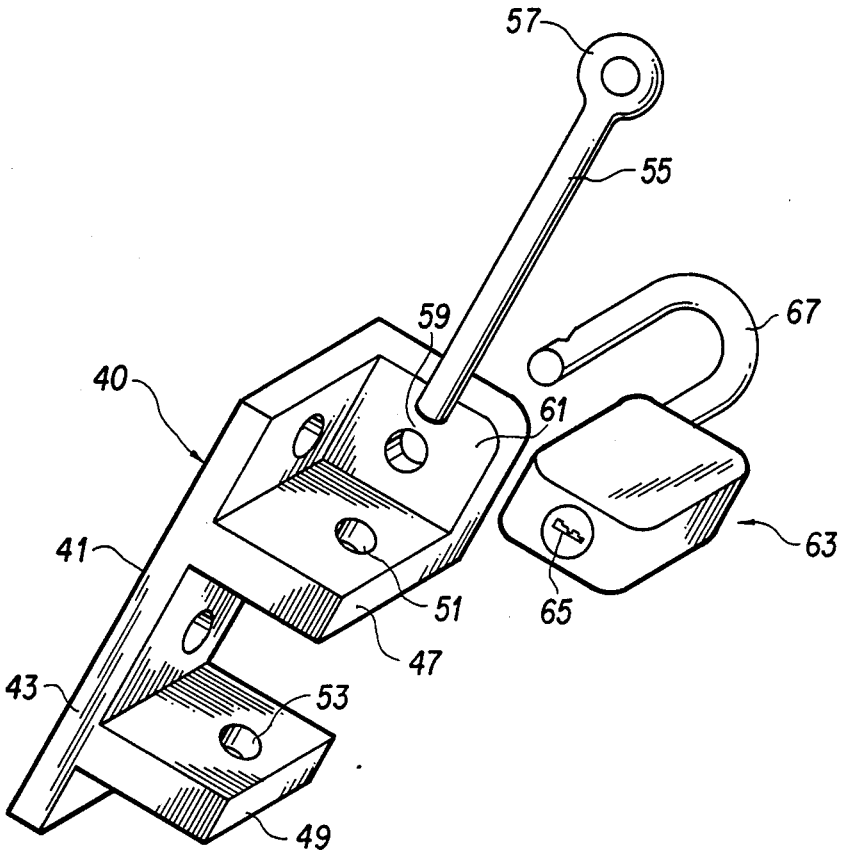
FIG. 2 shows an exploded perspective view of the oar locking device of the present invention.
Figure 3:
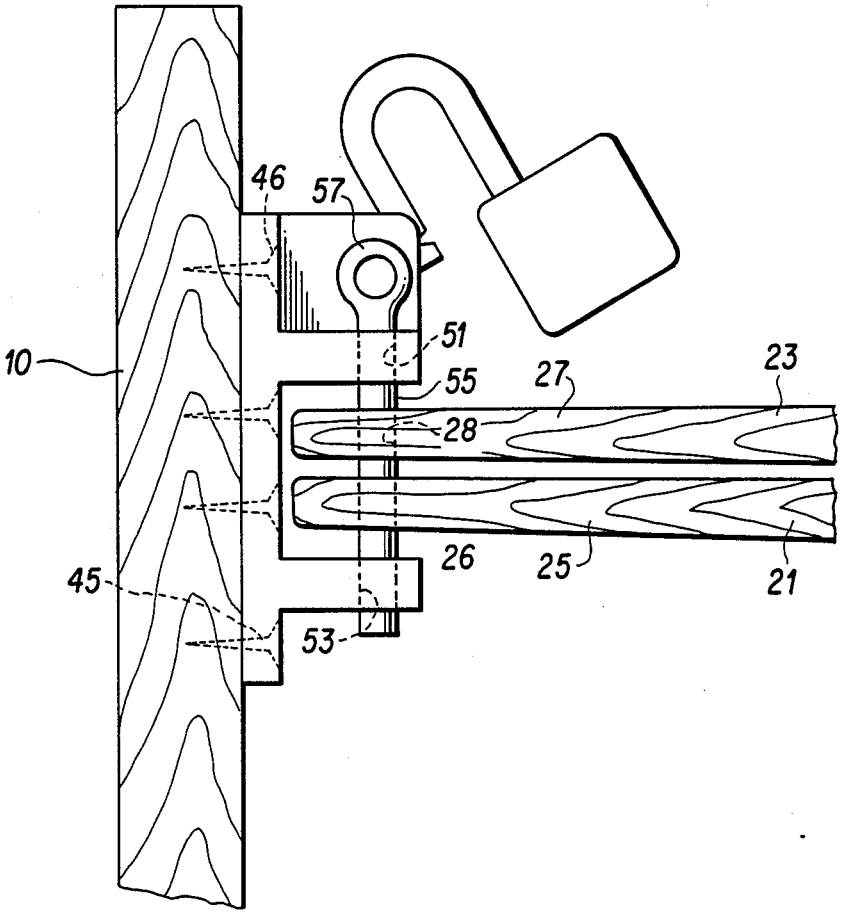
FIG. 3 shows a side view of the device best shown in FIG. 2 with two oars locked thereto.

In this regard, with reference, first, to FIGS. 2 and 3, a device designed to be used to lock the oars 21, 23 to the boat 10 is generally designated by the reference numeral 40 and is seen to include a receptacle 41 having a first wall 43 which may be attached to a structure on the boat such as the transom 13 or bow 11 through the use of screw-type fasteners 45, 46. The wall 43 has extending perpendicularly therefrom walls 47, 49 which have respective aligned openings 51, 53 therethrough. A pin 55 including an eyelet 57 may easily slide through the openings 51, 53 to a position where the eyelet 57 may be aligned with an opening 59 formed in a further wall 61 which, in the embodiment shown, is perpendicular to both the wall 41 and the wall 47. The padlock 63 includes a key receiving slot 65 as well as a padlock loop 67 which, as is well known, may be pivoted from the position shown to a locking position only releasable through insertion of a key into the slot 65 of the padlock 63.

With particular reference to FIG. 3, it is seen that the tips 25, 27 of the oars 21, 23 have alignable openings 26, 28 therethrough. In the operation of the inventive locking device 40, with the pin 55 removed from the aligned openings 51, 53, the tips 25, 27 may be inserted into the receptacle formed between the walls 47, 49 with the openings 26, 28 aligned with the openings 51, 53 in the respective walls 47, 49. With the openings 26, 28 of the oars so aligned within the above-described recess, the pin 55 may be inserted through the opening 51, opening 28, opening 26 and, finally, opening 53 until such time as the eyelet 57 thereof is aligned with the opening 59 in the wall 61. In such alignment, the loop 67 of the padlock 63 may be inserted through both the opening 59 and the eyelet 57 whereupon the padlock 63 may be locked to lock the oars in assembled relation thereon. In order to remove the oars therefrom, the above-described steps are merely reversed.

Figure 4:
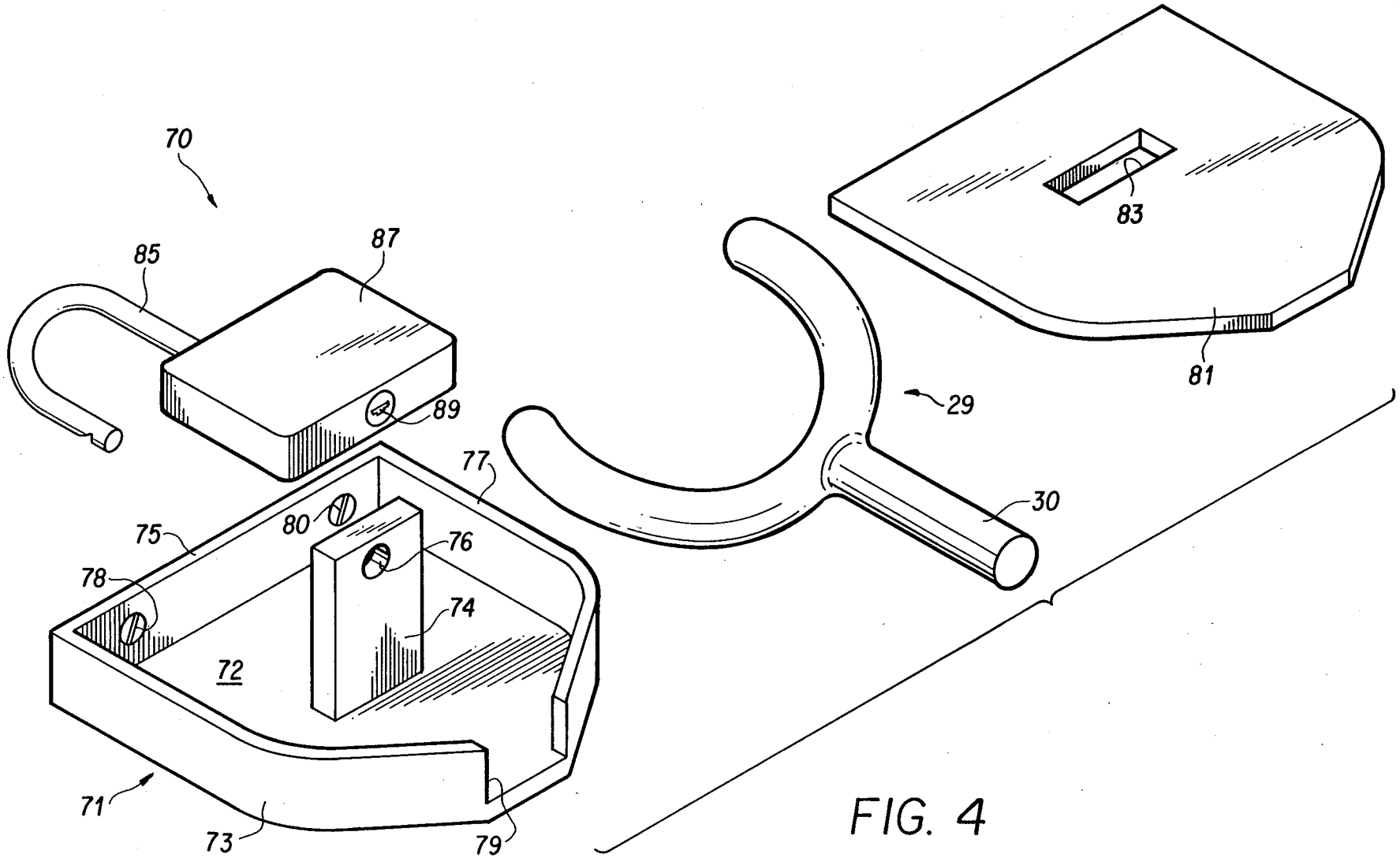
FIG. 4 shows an exploded perspective view of an oar lock locking device forming a part of the present invention.

With reference to FIG. 4, a further locking device in accordance with the teachings of the present invention is generally designated by the reference numeral 70 and is seen to include a receptacle 71 including circumferential walls 73, 75 and 77 with an opening 79 between the walls 73 and 77 allowing the stem 30 of the oar lock 29 to protrude therethrough.

The receptacle 71 includes a bottom wall 72 and an upstanding rectangularly shaped post 74 having an opening 76 near the top thereof. The receptacle 71 may be attached to suitable associated structure on the vessel such as, for example, the bow 11 or transom 13 by suitable means such as, for example, the fasteners 78, 80.

In a further aspect, a cover 81 is seen to have a configuration conforming to the shape of the interior of the receptacle 71 as defined by the walls 73, 75 and 77 and also includes a central slot 83 which, when the cover is placed over the receptacle 71, may easily fit over the post 74. The walls 73, 75 and 77 are sufficiently tall enough so that when two oar locks such as those designated by the reference numerals 29 and 31 in FIG. 1 are placed in the receptacle 71, the cover 81 may be placed over the post 74 and past the opening 76. In such position, the loop 85 of the padlock 87 may be inserted through the opening 76 and, thereafter, the padlock may be locked to lock the oar locks within the receptacle 71, only to be removed by insertion of a key (not shown) in the slot 89 of the padlock 87. Of course, to remove the oar locks from the locking device 70, reversal of the steps described above would be carried out.

Through use of the teachings of the present invention, the oar locks and oars of a boat may be locked to the boat in a manner which prevents theft of these accessories while providing structures which do not take up a lot of room on the boat. As such, through the use of the teachings of the present invention, absolute security may be obtained for accessories of a boat which are usually just left in the boat only to be stolen by enterprising thieves.

As such, an invention has been disclosed in terms of a preferred embodiment thereof embodied in two devices which fulfill each and every one of the objects of the present invention and provide an effective means for deterring and preventing theft.

Of course, various changes, modifications and alterations in the teachings of the present invention may be contemplated by those skilled in the art without departing from the intended spirit and scope of the present invention. As such, it is intended that the present invention only be limited by the terms of the appended claims.

I claim:

1. In a vessel having at least one oar separable therefrom, a locking device to lock said oar to said vessel comprising:

(a) a receptacle having two spaced walls and adapted to receive a portion of said oar therein;

(b) capturing means comprising a pin insertable through holes in said walls and oar for retaining said portion of said oar in said receptacle; and (c) locking means for locking said capturing means in position retaining said portion of said oar in said receptacle.

2. The invention of claim 1, wherein said locking means comprises a lock attachable between said receptacle and said pin to maintain said pin inserted through said holes.

3. The invention of claim 1, wherein said receptacle is attached to said vessel.

4. In a vessel having at least one oar lock separable therefrom, a locking device to lock said oar lock to said vessel comprising:

(a) a receptacle adapted to receive a portion of said oar lock therein, said receptacle including an upwardly extending post having an opening therethrough;

(b) capturing means comprising a cover adapted to cover said receptacle, said cover having an opening alignable with said upwardly extending post when said receptacle is placed in covering relationship to said receptacle, said upwardly extending post being adapted to extend through said opening in said cover with said post opening being exposed on a side of said cover remote from said receptacle;

(c) locking means interacting with said post opening for locking said cover in position retaining said portion of said oar lock in said receptacle;

(d) said oar lock including a stem which protrudes outwardly from an opening in said receptacle when said oar lock is locked therein.

5. The invention of claim 4, wherein said locking means comprises a lock having a loop insertable through said post opening.

* * * * *